US008985321B2

(12) United States Patent
Philips

(10) Patent No.: US 8,985,321 B2
(45) Date of Patent: Mar. 24, 2015

(54) SHIPPING AND DISPLAY CONTAINER

(71) Applicant: TIN Inc., Memphis, TN (US)

(72) Inventor: Nicholas A. Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 7 days.

(21) Appl. No.: 13/719,278

(22) Filed: Dec. 19, 2012

(65) Prior Publication Data

US 2014/0166507 A1 Jun. 19, 2014

(51) Int. Cl.
*B65D 5/42* (2006.01)
*B65D 5/54* (2006.01)

(52) U.S. Cl.
CPC ..... *B65D 5/5445* (2013.01)
USPC ..... 206/45.29; 206/736; 206/745; 206/767; 206/774; 229/235; 229/238; 229/240

(58) Field of Classification Search
CPC .... B65D 5/029; B65D 5/0035; B65D 5/2047; B65D 5/22; B65D 5/36; B65D 5/443; B65D 5/445; B65D 5/52; B65D 5/541; B65D 5/542; B65D 5/5405; B65D 5/5445
USPC ..... 206/736, 745, 774, 45.28–45.29, 767; 229/108.1, 109, 112, 123.2, 124, 164, 229/199, 235, 238–241, 919, 925
See application file for complete search history.

(56) References Cited

U.S. PATENT DOCUMENTS 3,002,613 A * 10/1961 Merkel et al. ..... 206/193
3,276,667 A * 10/1966 Johnson et al. ..... 206/557
3,447,733 A * 6/1969 Nelson et al. ..... 229/120.011
3,531,045 A * 9/1970 Johnson ..... 229/240
3,669,251 A 6/1972 Phillips, Jr.
3,927,761 A 12/1975 Boyle
4,008,849 A * 2/1977 Baber ..... 229/237
4,113,100 A * 9/1978 Soja et al. ..... 229/112
4,417,655 A 11/1983 Forbes, Jr.
4,815,609 A * 3/1989 Kiedaisch ..... 229/235
5,048,690 A 9/1991 Zimmerman
5,098,757 A * 3/1992 Steel ..... 428/34.2
5,582,345 A * 12/1996 Lankhuijzen ..... 229/235
5,651,497 A * 7/1997 Ventura et al. ..... 229/235
6,386,369 B2 5/2002 Yuhas et al.

(Continued)

FOREIGN PATENT DOCUMENTS

DE 202007015814 4/2009
GB 2464159 4/2010

*Primary Examiner* — Bryon Gehman
*Assistant Examiner* — Brijesh V. Patel
(74) *Attorney, Agent, or Firm* — Matthew M. Eslami

(57) ABSTRACT

The present invention is directed to a shipping container convertible into a display configuration at a point of sale which comprises a display base and a removable cover base. The removable cover base is integrally attached to the display base through two pairs of non-linear zipper perforations lines to form the shipping container convertible into a display configuration. The shipping container convertible into a display configuration comprises opposite side walls each having a length and a top edge and a bottom edge and opposite end walls each having a width and a top edge and a bottom edge. Top major and minor flaps are foldably joined to the top edges of the side walls and end walls, and bottom major and minor flaps are foldably joined to the bottom edges of the side walls and end walls.

12 Claims, 4 Drawing Sheets

(56) References Cited

U.S. PATENT DOCUMENTS

| | | | | |
|---|---|---|---|---|
| 6,478,159 | B1 | 11/2002 | Taylor et al. | |
| 6,510,982 | B2 | 1/2003 | White et al. | |
| 6,729,475 | B2 | 5/2004 | Yuhas et al. | |
| 6,832,683 | B2 * | 12/2004 | Boriani et al. | 206/273 |
| 6,974,033 | B2 * | 12/2005 | McLeod et al. | 206/736 |
| 7,175,066 | B2 | 2/2007 | Varanasi | |
| 7,320,407 | B2 | 1/2008 | Hubbs et al. | |
| 7,628,746 | B2 | 12/2009 | Varanasi | |
| 7,658,318 | B2 | 2/2010 | Walsh et al. | |
| 2003/0146270 | A1 | 8/2003 | Caille et al. | |
| 2004/0007495 | A1 | 1/2004 | Dye | |
| 2004/0149624 | A1 * | 8/2004 | Wischusen et al. | 206/736 |
| 2005/0000853 | A1 * | 1/2005 | Rochefort et al. | 206/736 |
| 2005/0173269 | A1 * | 8/2005 | Lebras | 206/170 |
| 2006/0006096 | A1 | 1/2006 | Funk | |
| 2006/0261140 | A1 | 11/2006 | Holley | |
| 2010/0000672 | A1 * | 1/2010 | Fogle | 156/253 |
| 2010/0224675 | A1 | 9/2010 | Bell et al. | |
| 2010/0276333 | A1 | 11/2010 | Couture | |
| 2011/0284621 | A1 | 11/2011 | Couture | |
| 2012/0085817 | A1 | 4/2012 | Gatrost et al. | |
| 2013/0105355 | A1 | 5/2013 | Keefe, Jr. | |

* cited by examiner

SHIPPING AND DISPLAY CONTAINER

FIELD OF THE INVENTION

This invention relates generally to containers for shipping products to points of sale. More particularly, the invention is a shipping container that is convertible to a display container at the point of sale.

BACKGROUND OF THE INVENTION

It is common practice to load a quantity of individual packages of consumer products into corrugated paperboard shipping containers for bulk shipment of the packages to a point of sale. At the point of sale, the individual packages are removed from the shipping container and placed on a shelf for display and sale to the consumer.

In many instances, especially in the club stores, the product packages are left in the shipping container which then also serves to support and display the packages for sale. If the shipping container is a conventional box, then the retailer must cut away a portion of the box in order to expose the product packages and provide access to them by the consumers. In order to provide a more attractive display and facilitate ease of use by the retailer, combination of shipping and display containers have been developed which have sections that may be removed along weakened lines to expose the product packages and provide access to them.

Some conventional shipping and display containers require multiple pieces of corrugated material in their construction and/or are not easily produced on standard Regular Slotted Container (RSC) plant converting equipment. Conventional designs also may not provide a container that retains its integrity during shipping and handling, and/or the retailer may be required to use a knife to open the shipping container to convert it to a display configuration. Additionally, removal of a section of conventional shipping and display containers frequently leaves a jagged edge that is unattractive.

Of additional concern with conventional shipping and display containers is their inability to ship bagged, pouched or carded products in a flat or horizontal position and then display them at the point of sale in an upright position.

Accordingly, it would be desirable to have a shipping and display container that uses a single piece of corrugated material in its construction, that can be easily produced on standard box plant converting equipment, that retains its integrity during shipping and handling, that does not require the use of a knife or other tool to convert it from a shipping to a display configuration.

SUMMARY OF THE INVENTION

The present invention provides a shipping container that is easily convertible to a display configuration at a point of sale. The container requires a single piece of corrugated material in its construction and can be produced on standard Regular Slotted Container (RSC) plant converting equipment. The RSC container retains its integrity during shipping and handling and does not require the use of a knife or other tool to convert it from a shipping configuration to a display configuration. In its shipping configuration, the container has first and second side walls, opposed end walls, and major and minor flaps on the top and bottom edges of the side and end walls forming top and bottom walls. At the point of sale, the container is stood on one end the two pairs of non-linear zipper perforations each of which extend across the length of the respective end walls and width the respective minor flaps that foldably joined to the respective end walls are used to separate a removable cover base from a display base.

Each of the pairs of non-linear zipper perforations defines a boundary of the display base from the removable cover base that when removed forms the display configuration. In the preferred embodiment of the invention, the top major flaps have different width with respect to one another and the bottom major flaps have different width with respect to one another and the top and bottom major flaps are un-aligned with one another when the major flaps are in folded positions. However, one of ordinary skill in the art would appreciate that the width of each of the top and bottom major flaps may be the same size and be aligned with one another when they are in their respective folding positions. The first side wall includes first major flaps each of which foldably joined from respective longitudinal edges thereof and the second side wall includes second major flaps each of which foldably joined from respective longitudinal edges thereof. Each of the first major flaps has a larger width than each of the second major flaps and the first major flaps is part of the removable cover base. The second major flaps are part of the display base. Each pair of the non-linear zipper perforations terminates at free edges of the respective top and bottom minor flaps and each pair of the non-linear zipper perforations includes a finger access tab for pulling the tab to initiate tearing of the perforated lines and to remove the non-linear zipper.

The shipping and display container of the invention is made from a single blank of corrugated paperboard cut and scored to define first, second, third and fourth wall panels foldably joined along adjacent side edges and, with reference to the orientation of a container during filling and shipping, having top and bottom edges. Top major and minor flaps are foldably joined to the top edges of the side walls and end walls, and bottom major and minor flaps are foldably joined to the bottom edges of the side walls and end walls. The blank may be cut, scored and folded on standard RSC box plant converting equipment. The manufacturer of the shipping and display container folds the blank about a fold line between its ends and adhesively attaches a glue tab on one end of the blank to the opposite end of the blank to form a flattened tubular construction that is shipped to a customer who erects the flattened construction into a finished container and fills it with packages of product for shipment to a point of sale.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
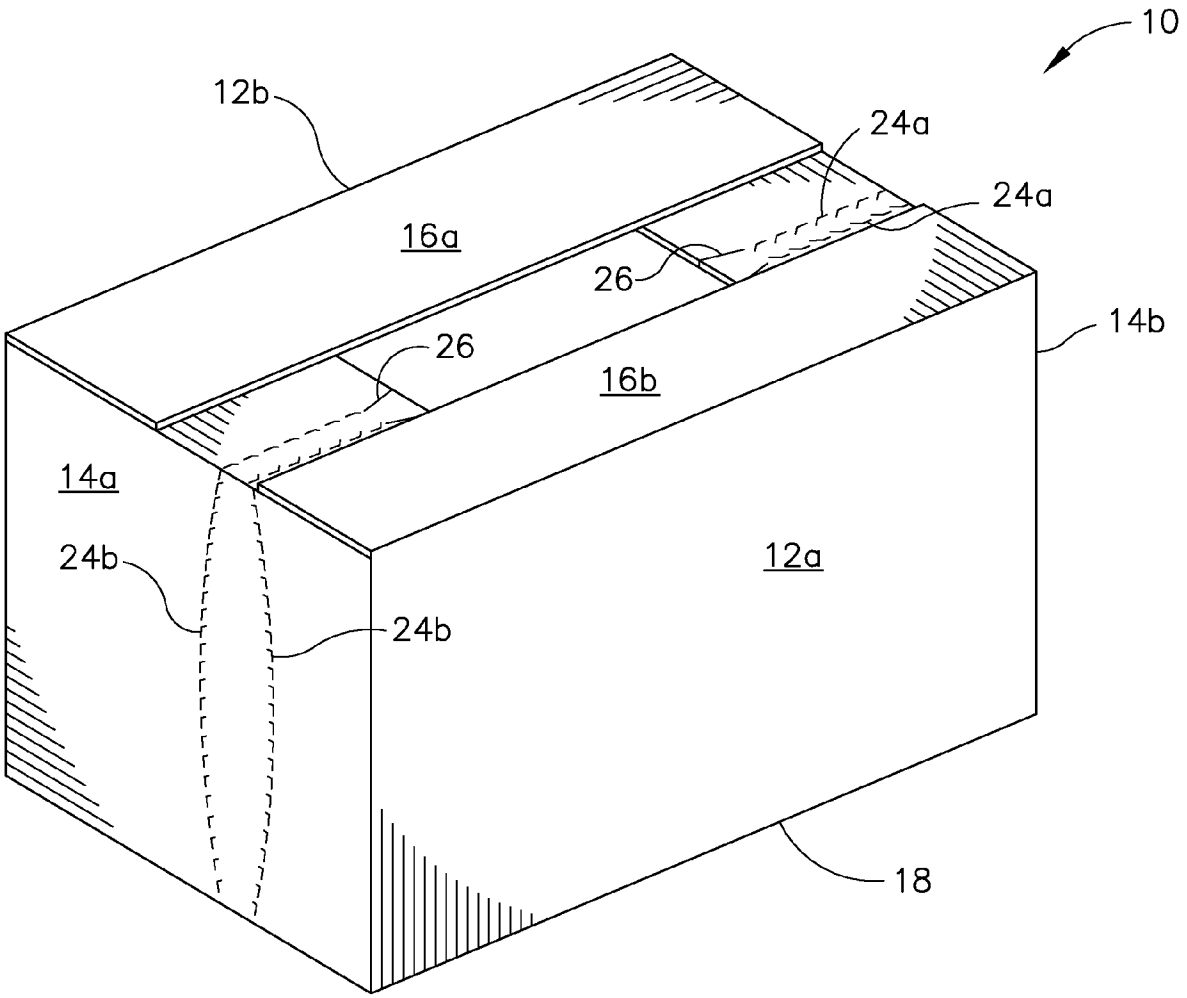
FIG. 1 is a front top isometric view of a shipping and display container according to the invention, shown in its shipping configuration.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

Figure 2:
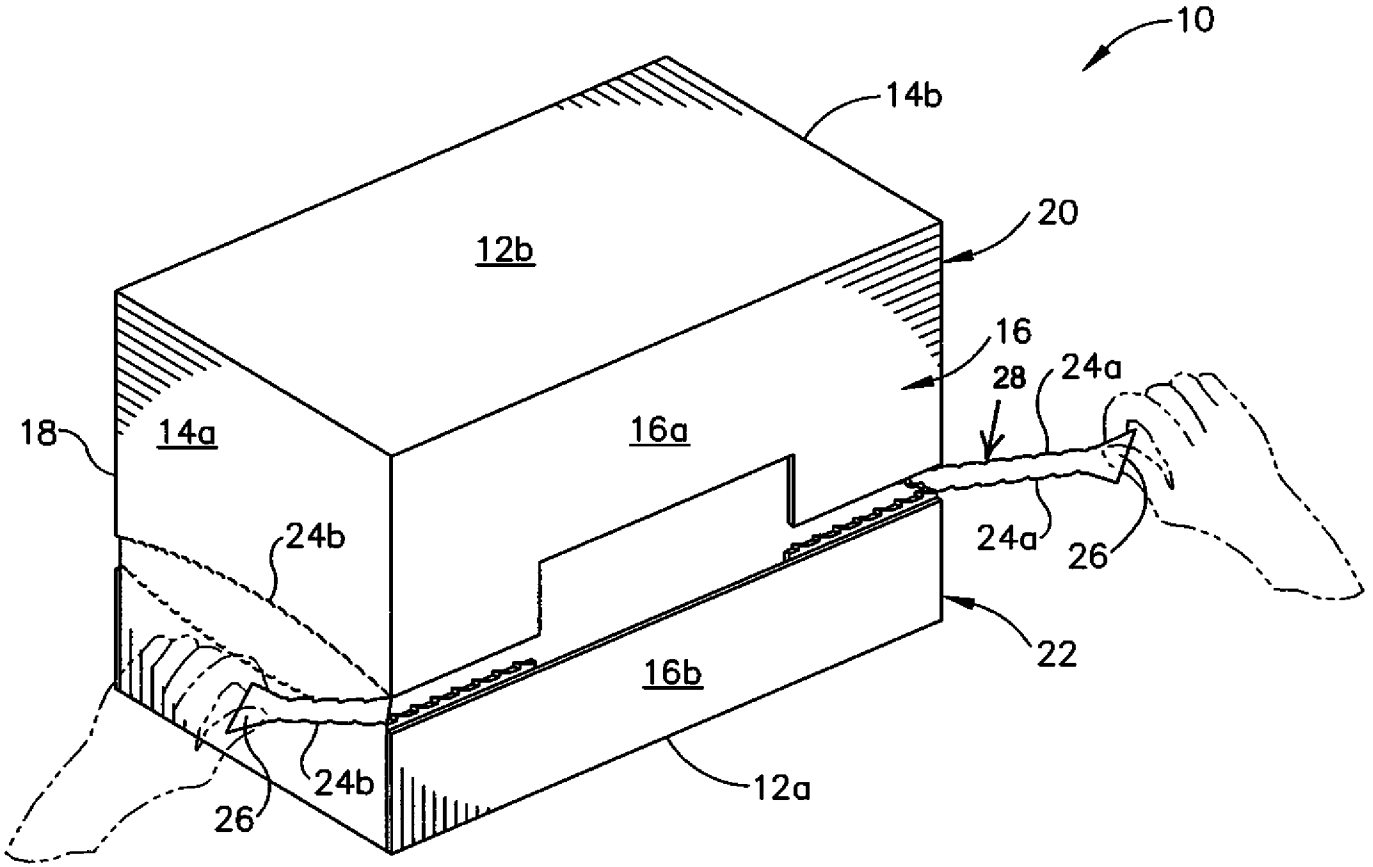
FIG. 2 is a front top isometric view showing the container of the invention in the process of being opened.

A shipping and display container according to the invention is indicated generally at 10 in FIG. 1 in its shipping configuration. The container 10 comprises opposite side walls 12*a*, 12*b*, end walls 14*a*, 14*b*, and top and bottom walls 16 and 18. At the point of sale, the container 10 is oriented in its display configuration by flipping it onto its side wall 12*a* as shown in FIG. 2 and removing a removable cover base 20 to form a display opening extending over a portion of what now constitutes a display base 22 to expose the upright product packages P in the container. The top and bottom walls 16 and 18 are defined by top major and minor flaps 16*a*, 16*b* and 18*a*, 18*b* foldably joined to the top edges of the side walls 12*a*, 12*b* and end walls 14*a*, 14*b*, and bottom major and minor flaps 16*c*, 16*d* and 18*c*, 18*d* foldably joined to the bottom edges of the side walls and end walls. The removable cover base 20 is separated from the display base 22 along the two pairs of non-linear zipper perforation lines 24*a*, 24*b*. The two pairs of non-linear zipper perforation lines 24*a*, 24*b* each of which extends across the length of the respective end walls 14*a*, 14*b* and the width of respective minor flaps 18*a*, 18*b*, 81*c*, and 18*d* that foldably joined to the respective end walls and in which each of the pairs of non-linear zipper perforation lines define a boundary of the display base 22 from the removable cover base 20 that when removed forms the display configuration.

In the preferred embodiment of the invention, the respective top major flaps 16*a*, 16*b* have different width with respect to one another and the bottom major flaps 16*c*, 16*d* have different width with respect to one another. However, the major flaps 16*a*, 16*c* have the same width and major flaps 16*b*, 16*d* have the same width as well. It should be noted that the different width in respective top and bottom major flaps has no bearing on the operation of the invention and as one of the ordinary skill in the art would appreciate, the width of the top and bottom major flaps may be the same so that the top major flaps would aligned with one another and similarly, the bottom major flaps would aligned with one another as well. The top major flaps 16*a*, 16*b* are un-aligned with one another when they are in folded positions. The first side wall 12*b* includes first major flaps 16*a*, 16*c* each of which foldably joined from respective longitudinal edges thereof and the second side wall 12*a* includes second major flaps 16*b*, 16*d* each of which foldably joined from respective longitudinal edges thereof. As noted, each of the respective first major flaps 16*a*, 16*c* has a larger width than each of the respective second major flaps 16*b*, 16*d*. The first major flaps 16*a*, 16*c* are part of the removable cover base 20. The second major flaps 16*b*, 16*d* are part of the display base 22. The non-linear zipper perforation lines 24*a* begins at free edge of the minor flap 18*a*' and terminate at the free edge of the minor flap 18*b*'. Similarly, the non-linear zipper perforation lines 24*b* begins at free edge of the minor flap 18*c*' and terminate at the free edge of the minor flap 18*d*'. Each pair of the non-linear zipper perforation lines 24*a*, 24*b* includes a finger access tab 26 for pulling the finger access tab 26 to initiate tearing of the perforated lines 24*a*, 24*b* and removing the non-linear zipper 28.

Figure 3:
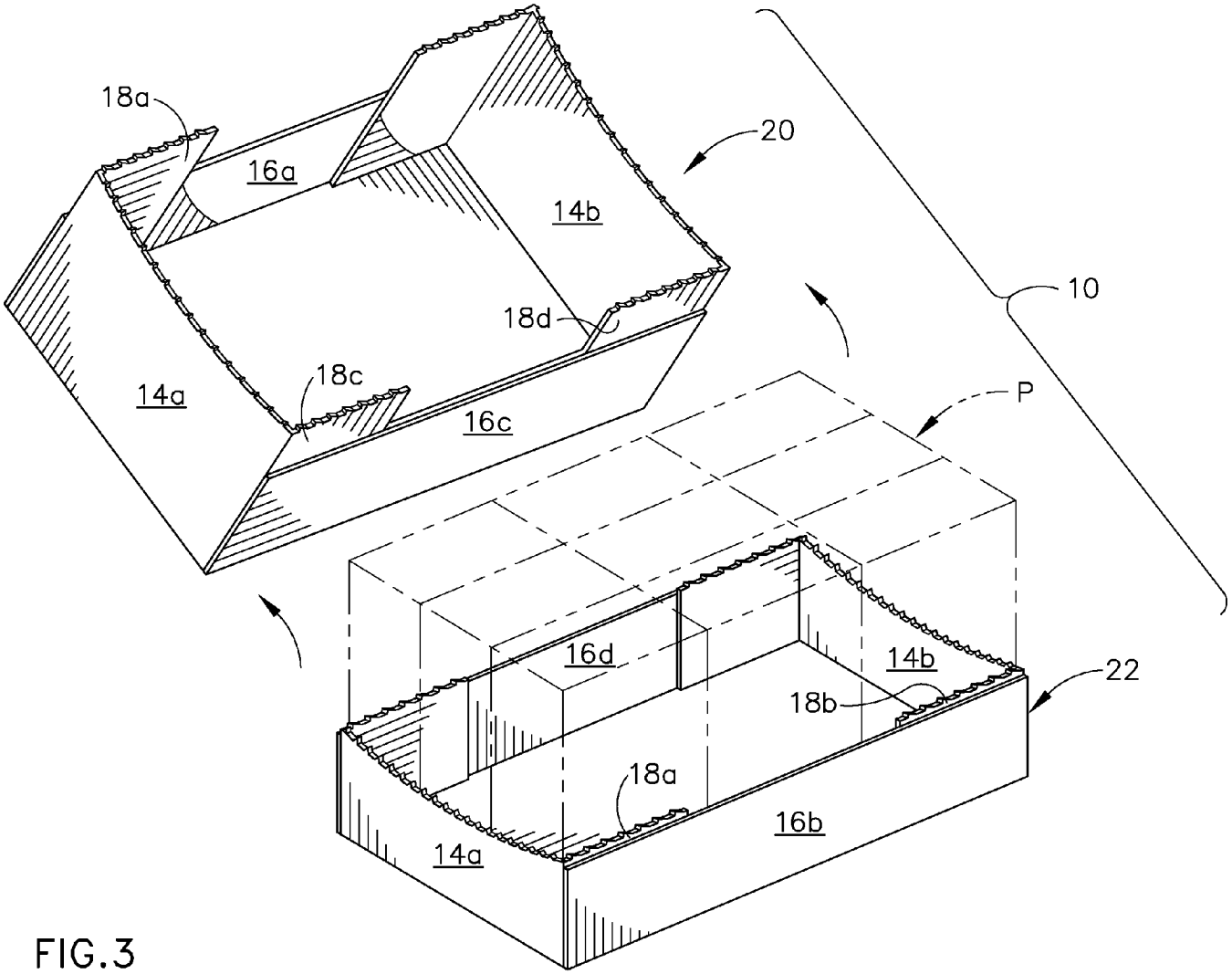
FIG. 3 is an isometric view of the container opened into a display base in an operative position and a removable cover base detached from the display base.

Referring to FIG. 3 that illustrates an isometric view of the container 10 opened into a display base 22 in an operative position and a removable cover base 20 detached from the display base 22. The display base 22 contains the upright product packages P for easy access by the customer in a retail store. It should be noted that the display base 22 accommodates products that are packed into cases with their display facings in a parallel plane to the major and minor flaps 16*b*, 16*d*, 18*a*, and 18*b*. Furthermore, this orientation minimize any negative effect on stacking strength and/or packing materials costs the display features may cause during handling. The container 10 is particularly configured so that the display base 22 has a lower profile as compared to a profile of the removable cover base 20. The use of non-linear zipper perforations 24*a*, 24*b* in a precise locations on the end wall 14*a*, 14*b* and minor flaps 18*a*, 18*b*, 18*c*, and 18*d* prevents the side walls 12*a*, 12*b* and end walls 14*a*, 14*b* from buckling and/or folding during high speed manufacturing of folding and gluing process of the blank 30, as depicted in FIG. 4, for making the container 10.

Figure 4:
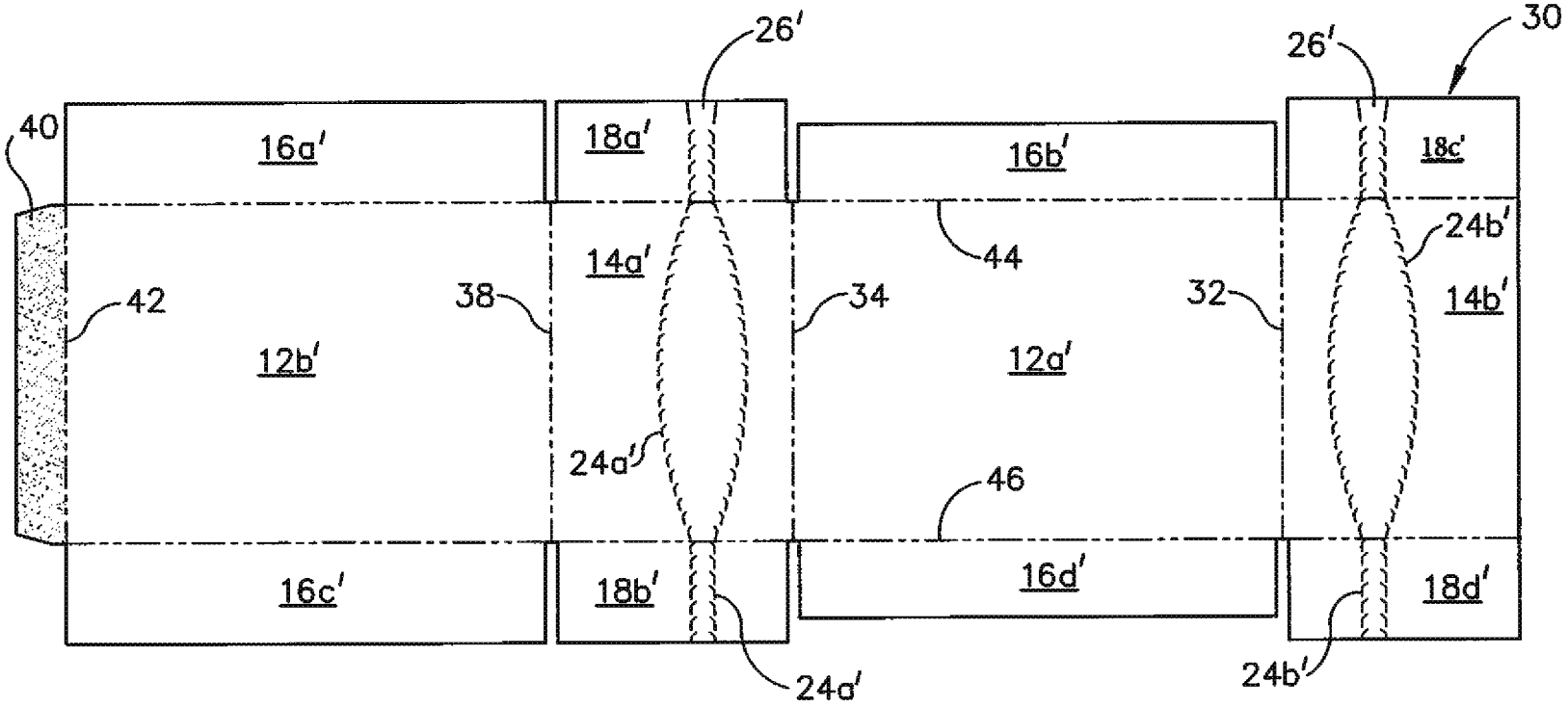
FIG. 4 is a plan view of the blank used in making the container of the invention.

FIG. 4 is a plan view of the blank 30 used in making the container 10 of the invention. The blank 30 is substantially flat symmetrical with respect to its longitudinal axis thereof. The blank 30 is preferably an integral piece of a material such as continuous sheet of conventional corrugated cardboard. The blank 30 is cut along its outer margins to form its specific shape. The blank 30 is divided into two sidewalls 12*a*', 12*b*', and two end walls 14*a*', 14*b*' by three parallel fold lines 32, 34, and 38 and major and minor top flaps 16*a*', 16*b*', 18*a*', and 18*c*'forming the top wall 16' by fold line 44 and major and minor bottom flaps 16*c*', 16*d*', 18*b*', and 18*d*' forming the bottom wall 18 by fold line 46. A glue tab 40 is foldably extend from the side wall 12*b*' and define by fold line 42. The glue tab 40 attaches one end of the blank 30 to the opposite end of the blank to form a flattened tubular construction that is shipped to a customer who erects the flattened construction into a finished container and fills it with packages of product for shipment to a point of sale. The two pairs of non-linear zipper perforation lines 24*a*, 24*b* each of which extends across the length of the respective end walls 14*a*, 14*b* and the width of respective minor flaps 18*a*, 18*b*, 81*c*, and 18*d* that foldably joined to the respective end walls and in which each of the pairs of non-linear zipper perforation lines 24*a*', 24*b*' define a boundary of the display base 22 from the removable cover base 20 that when removed forms the display configuration.

To construct the blank 30, the glue tab 40' attaches one end of the blank 30 to the opposite end of the blank that is end wall 14*b*' to form a flattened tubular construction. Next, major and minor bottom flaps 16*c*', 16*d*', 18*b*', 18*d*' are folded at right angle toward one another along the respective fold line 46 and glued to one another. Next, the products P are placed in the interior space of the container 10 and finally, major and minor top flaps 16*a*', 16*b*', 18*a*', and 18*c*' and are folded at right angle toward one another along the respective fold line 44 and glued to one another to enclose the container for shipping. At the point of sale, the merchant grab the finger access tab 26 and pulls outwardly to break the lines of perforation 24*a*, 24*b* so that the non-linear zipper 28 is removed. This enables the removable cover base 20 of the container 10 to be detached from the display base 22.

Accordingly, one aspect of the present invention is directed to a shipping container convertible into a display configuration at a point of sale which comprises a display base and a removable cover base. The removable cover base is integrally attached to the display base through two pairs of non-linear zipper perforations lines to form the shipping container convertible into a display configuration. The shipping container convertible into a display configuration comprises opposite side walls each having a length and a top edge and a bottom edge and opposite end walls each having a width and a top edge and a bottom edge. Top major and minor flaps are foldably joined to the top edges of the side walls and end walls, and bottom major and minor flaps are foldably joined to the bottom edges of the side walls and end walls. The two pairs of non-linear zipper perforations lines each of which extends across the length of the respective end walls and width of respective minor flaps that are foldably joined to the respective end walls. Each of the pairs of non-linear zipper perforations defines a boundary of the display base from the removable cover base that when removed forms the display configuration. The top major flaps have different width with respect to one another and the bottom major flaps have different width with respect to one another. The top and bottom major flaps are un-aligned with one another when the major flaps are in folded positions. The opposed side walls is defined by first and second side walls. The first side wall includes first major flaps each of which is foldably joined from respective longitudinal edges thereof and the second side wall includes second major flaps each of which is foldably joined from respective longitudinal edges thereof. Each of the first major flaps has a larger width than each of the second major flaps and the first major flaps comprise a part of the removable cover base. The second major flaps comprise a part of the display base. Each pair of the non-linear zipper perforations terminates at free edges of the respective top and bottom minor flaps. Each pair of the non-linear zipper perforations includes a finger access tab for pulling the tab to initiate tearing of the perforated lines and to remove the non-linear zipper. The display base has a lower profile as compared to a profile of the removable cover base.

Another aspect of the present invention is directed to a blank for making a shipping container convertible into a display configuration at a point of sale which comprises a first side wall panel at a first end of the blank and a first end wall panel adjoins the first side wall panel. A second side wall panel adjoins the first end wall panel along an edge opposite that edge joined to the first side wall panel. A second end wall panel adjoins the second side wall panel along an edge opposite the first end wall panel. A glue tab is foldably joined to an edge of the first side wall panel opposite the edge joined to the first end wall panel. First major flaps each of which is foldably joined to respective longitudinal edges of the first side wall panel. First minor flaps each of which is foldably joined to respective lateral edges of the first end wall panel. Second major flaps each of which is foldably joined to respective longitudinal edge of the second side wall panel. Second minor flaps each of which is foldably joined to respective lateral edges of the second end wall panel. A first pair non-linear zipper perforations lines extend across the length of the first end wall panel and width of first minor flaps. A second pair non-linear zipper perforations lines extends across the length of the second end wall panel and width of second minor flaps.

While particular embodiments of the invention have been illustrated and described in detail herein, it should be understood that various changes and modifications may be made in the invention without departing from the spirit and intent of the invention as defined by the appended claims.

What is claimed is:

1. A shipping container convertible into a display configuration at a point of sale, comprising:

a display base; and a removable cover base integrally attached to the display base through two pairs of non-linear zipper perforation lines to form the shipping container convertible into a display configuration wherein:

the shipping container comprises opposite side walls each of which having a length and a top edge and a bottom edge, opposite end walls each having a length and a top edge and a bottom edge, top major and minor flaps foldably joined to the top edges of the side walls and end walls, and bottom major and minor flaps foldably joined to the bottom edges of the side walls and end walls wherein the top major flaps have different widths with respect to one another and the bottom major flaps have different widths with respect to one another and wherein the respective top and bottom major flaps are un-aligned with one another when the major flaps are in folded positions, the two pairs of non-linear zipper perforation lines each of which extending across the length of the respective end walls and the width of the respective minor flaps that foldably joined to the respective end walls and each of the pairs of non-linear zipper perforation lines being formed off-center of the respective end walls and the respective minor flaps and wherein each pair of non-linear zipper perforation lines having a convex shape and being substantially confined between two parallel fold lines and wherein each of the pairs of non-linear zipper perforation lines define a boundary of the display base from the removable cover base that when removed forms the display configuration and wherein the display base has a lower profile than a profile of the removable cover base.

2. The shipping container of claim 1 wherein the opposite side walls are defined by first and second side walls wherein the first side wall includes a first major flaps each of which foldably joined from a respective longitudinal edges thereof and the second side wall includes a second major flaps each of which foldably joined from a respective longitudinal edges thereof.

3. The shipping container of claim 2 wherein each of the first major flaps has a larger width than each of the second major flaps.

4. The shipping container of claim 2 wherein the first major flaps are part of the removable cover base.

5. The shipping container of claim 2 wherein the second major flaps are part of the display base.

6. The shipping container of claim 1 wherein each pair of the non-linear zipper perforation lines terminate at free edges of the respective top and bottom minor flaps.

7. The shipping container of claim 1 wherein each pair of the non-linear zipper perforation lines includes a finger access tab for pulling the finger access tab to initiate tearing of the non-linear zipper perforated lines and to remove a non-linear zipper.

8. A shipping container convertible into a display configuration at a point of sale, comprising:

a display base; and a removable cover base integrally attached to the display base through two pairs of non-linear zipper perforations line to form the shipping container convertible into a display configuration wherein:

the shipping container comprises opposite side walls each of which having a length and a top edge and a bottom edge, the opposite side walls being defined by a first side wall and a second side wall wherein the first side wall includes first major flaps each of which foldably joined from respective longitudinal top and bottom edges and the second side wall includes second major flaps each of which foldably joined from longitudinal top and bottom edges wherein each of the first major flaps has a larger width than each of the second major flaps, opposite end walls each having a length and a top edge and a bottom edge, top minor flaps foldably joined to the top edges of the end walls, and bottom minor flaps foldably joined to the bottom edges of the end walls, the two pairs of non-linear zipper perforation lines each of which extending across the length of the respective end walls and the width of the respective minor flaps that foldably joined to the respective end walls and each of the pairs of non-linear zipper perforation lines being formed off-center of the respective end walls and the respective minor flaps and wherein each of the pairs of non-linear zipper perforation lines having a convex shape and being substantially confined between two parallel fold lines and wherein each of the pairs of non-linear zipper perforation lines defines a boundary of the display base from the removable cover base that when removed forms the display configuration and wherein the display base has a lower profile than a profile of the removable cover base.

9. The shipping container of claim 8 wherein the top and bottom of the first and second major flaps are un-aligned with one another when the top and bottom of the first and second major flaps are in folded positions.

10. The shipping container of claim 8 wherein the first major flaps are part of the removable cover base.

11. The shipping container of claim 8 wherein the second major flaps are part of the display base.

12. A blank for making a shipping container convertible into a display configuration at a point of sale, the blank comprising:

a first side wall panel at a first end of the blank;

a first end wall panel adjoining the first side wall panel;

a second side wall panel adjoining the first end wall panel along an edge opposite that edge joined to the first side wall panel;

a second end wall panel adjoining the second side wall panel along an edge opposite the first end wall panel;

a glue tab foldably joined to an edge of the first side wall panel opposite the edge joined to the first end wall panel;

first major flaps each of which being foldably joined to respective longitudinal edges of the first side wall panel;

first minor flaps each of which being foldably joined to respective lateral edges of the first end wall panel;

second major flaps each of which being foldably joined to respective longitudinal edges of the second side wall panel;

second minor flaps each of which being foldably joined to respective lateral edges of the second end wall panel;

a first pair non-linear zipper perforation lines extending across the length of the first end wall panel and width of first minor flaps; and a second pair non-linear zipper perforation lines extending across the length of the second end wall panel and width of second minor flaps and wherein each of the respective first and second pairs of non-linear zipper perforation lines having a convex shape and being substantially confined between two parallel fold lines and each of the respective first and second pairs of non-linear zipper perforation lines are being formed off-center of the respective end walls and the respective minor flaps.

* * * * *